US005190396A

United States Patent [19]

Aoyagi et al.

[11] Patent Number: 5,190,396

[45] Date of Patent: Mar. 2, 1993

[54] CONCRETE LEVELING APPARATUS

[75] Inventors: Hayao Aoyagi; Tateo Kawamura; Minoru Ochiai; Kenji Okuda, all of Tokyo; Toru Shimano; Kazuo Yamazaki, both of Chiba, all of Japan

[73] Assignees: Takenaka Corporation, Osaka; Sanwa Kizai Co., Ltd., Tokyo, both of Japan

[21] Appl. No.: 768,576

[22] PCT Filed: Jun. 27, 1990

[86] PCT No.: PCT/JP90/00832

§ 371 Date: Sep. 20, 1991

§ 102(e) Date: Sep. 20, 1991

[87] PCT Pub. No.: WO91/11574

PCT Pub. Date: Aug. 8, 1991

[30] Foreign Application Priority Data

| | | | |
|---|---|---|---|
| Jan. 26, 1990 | [JP] | Japan | 2-6879[U] |
| Jan. 26, 1990 | [JP] | Japan | 2-6880[U] |
| Jun. 7, 1990 | [JP] | Japan | 2-148950[U] |
| Jun. 19, 1990 | [JP] | Japan | 2-64753 |

[51] Int. Cl.[5] ..... E01C 19/22; E01C 19/00

[52] U.S. Cl. ..... 404/84.5; 404/119

[58] Field of Search ..... 404/119, 118–120, 404/96, 84.5

[56] References Cited

U.S. PATENT DOCUMENTS

| | | | |
|---|---|---|---|
| 3,540,359 | 11/1970 | Swisher et al. | 404/118 X |
| 4,068,970 | 1/1978 | Rowe . | |
| 4,466,757 | 8/1984 | Allen . | |
| 4,577,994 | 3/1986 | Miller | 404/119 X |
| 4,655,633 | 4/1987 | Somero et al. . | |
| 4,682,908 | 7/1987 | Domenighetti | 404/118 X |
| 4,688,965 | 8/1987 | Smith et al. | 404/118 X |
| 4,758,114 | 7/1988 | Artzberger | 404/119 |
| 4,778,305 | 10/1988 | Ritchey et al. . | |
| 4,822,210 | 4/1989 | Oury et al. . | |
| 4,995,760 | 2/1991 | Probst et al. | 404/119 |

FOREIGN PATENT DOCUMENTS

| | | |
|---|---|---|
| 3500277 | 10/1986 | Fed. Rep. of Germany . |
| 65305 | 2/1956 | France . |
| 49-23420 | 3/1974 | Japan . |
| 54-89822 | 6/1979 | Japan . |
| 62-55375 | 3/1987 | Japan . |
| 62-101703 | 5/1987 | Japan . |
| 63-233163 | 9/1988 | Japan . |
| 1-239267 | 9/1989 | Japan . |

*Primary Examiner*—Ramon S. Britts
*Assistant Examiner*—Nancy P. Connolly
*Attorney, Agent, or Firm*—Beveridge, DeGrandi, Weilacher & Young

[57] ABSTRACT

A concrete leveler comprises rails that are laid on both sides of a poured concrete surface, a traveling beam that spans the rails and freely travels along them, a traveling unit that is mounted so as to be freely movable along the beam in a direction perpendicular with respect to the direction of travel of that beam, and a concrete leveler portion that is provided to the traveling unit, and wherein this concrete leveling portion has a screw that is axially mounted so as to be freely and rotationally driven between support legs of the traveling unit, and that crosses a direction of travel of the traveling unit.

7 Claims, 15 Drawing Sheets

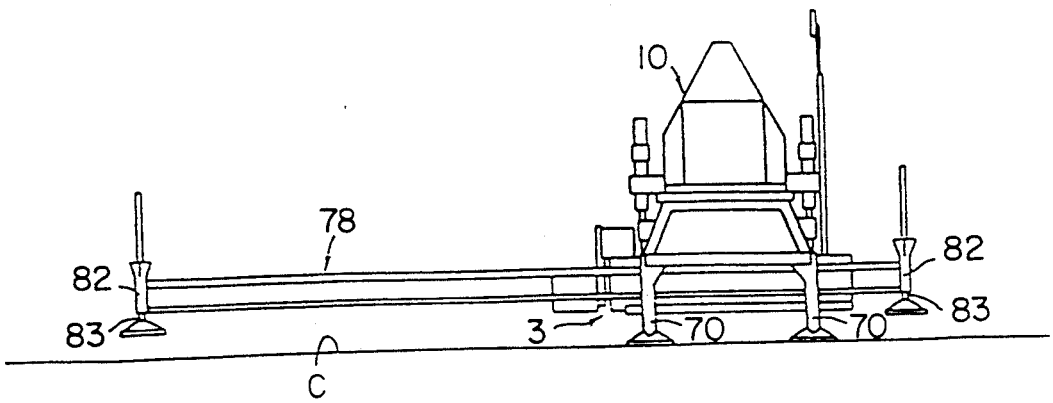
FIG.18(A) LEVELING
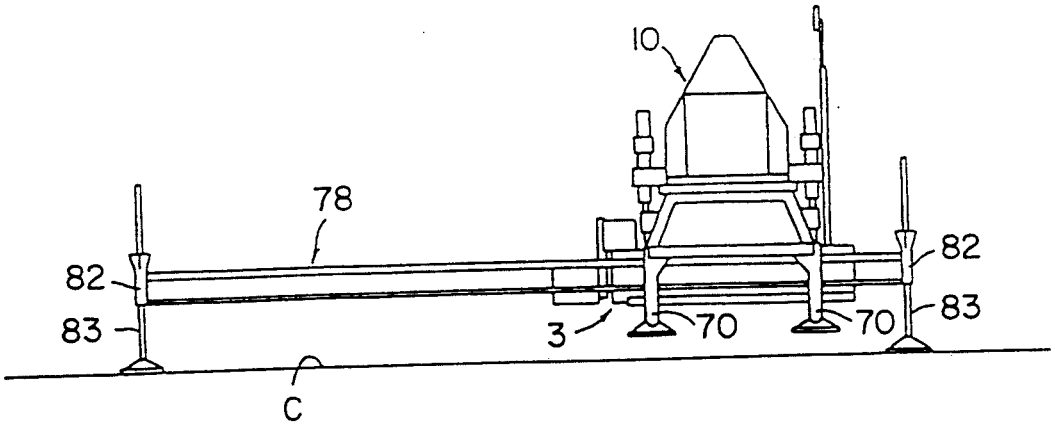
FIG.18(B) ENTIRE JACK-UP
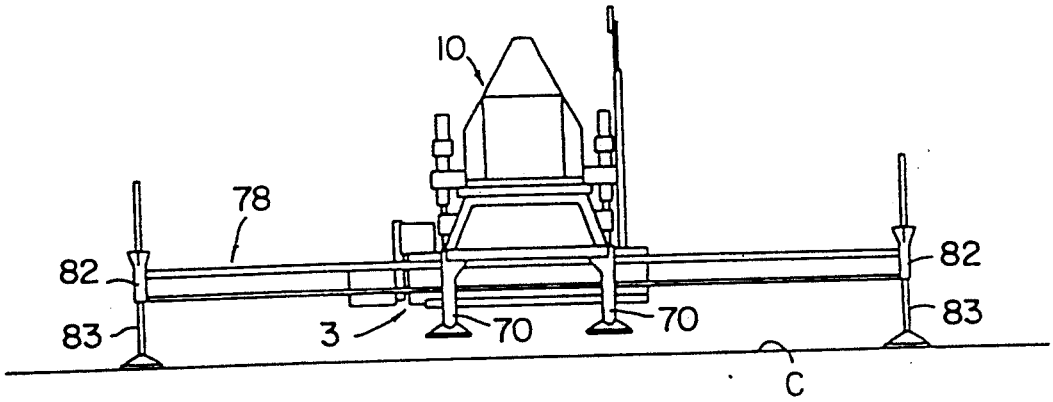
FIG.18(C) TRAVELING

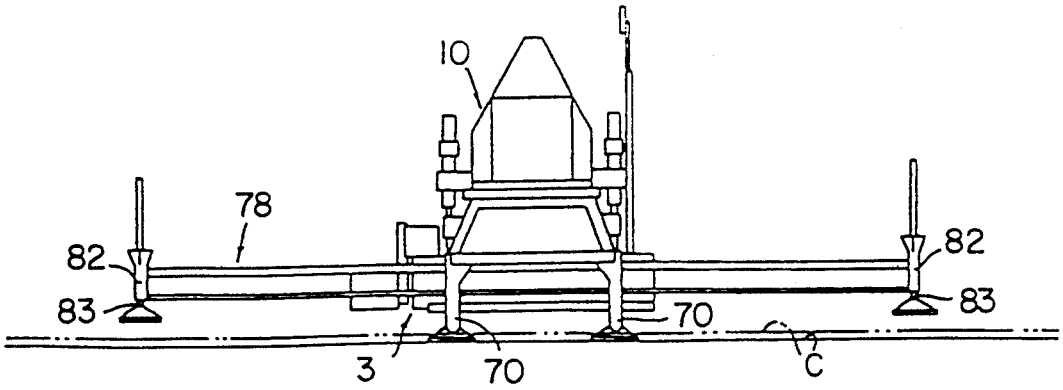
FIG. 18(D) ENTIRE JACK-DOWN → LEVELING
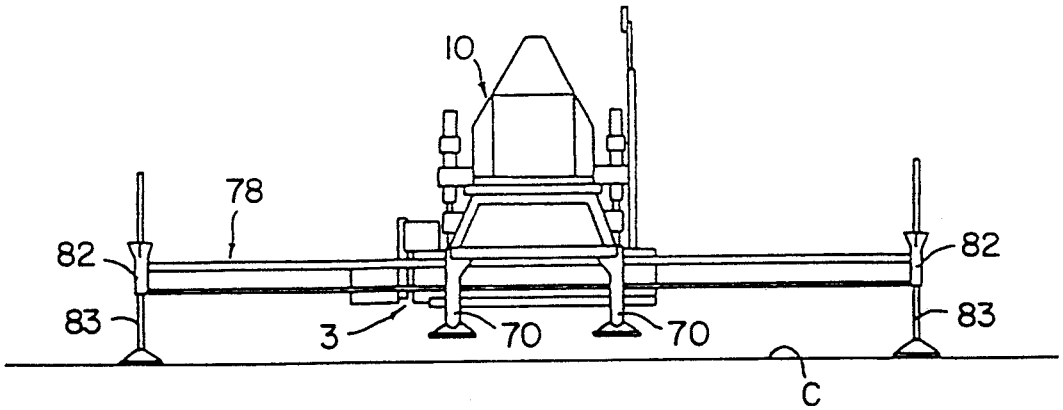
FIG. 18(E) ENTIRE JACK-UP
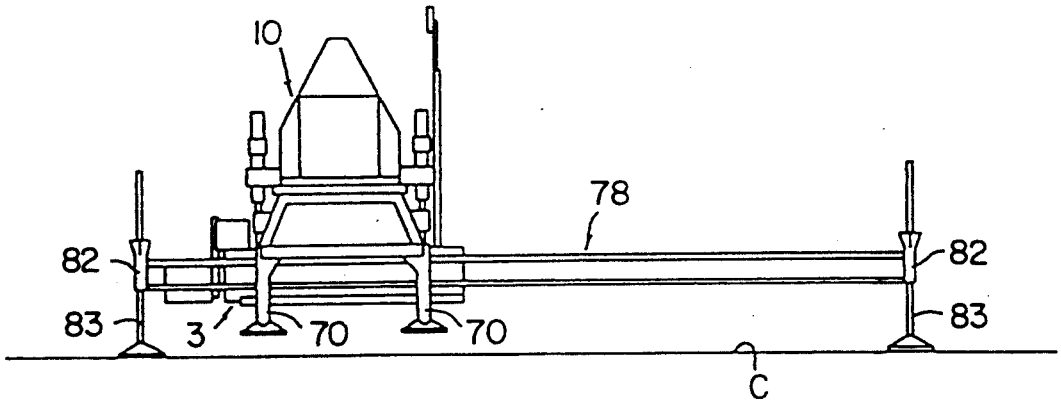
FIG. 18(F) TRAVELING

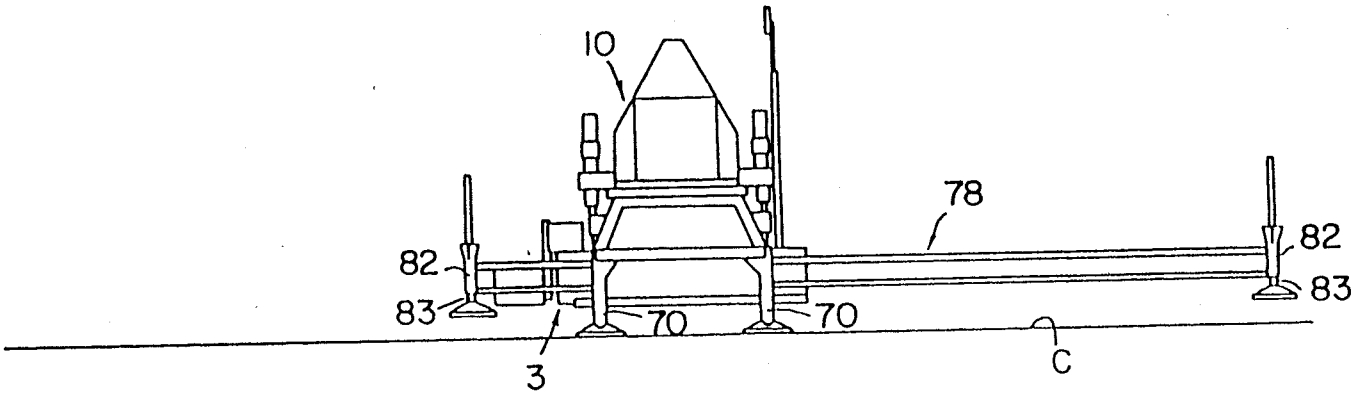
FIG. 18(G) ENTIRE JACK-DOWN
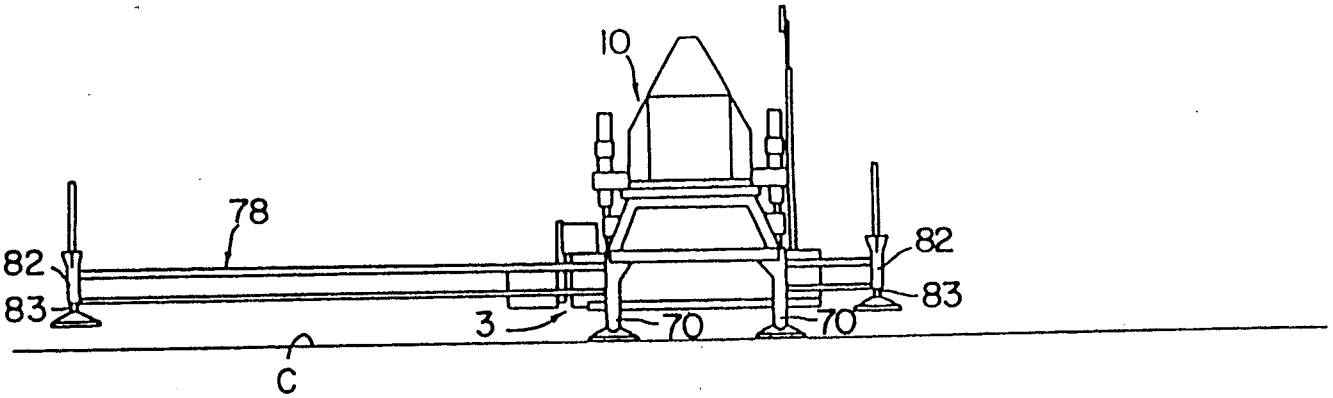
FIG. 18(H) SENDING RAILS → RETURN TO (A)

CONCRETE LEVELING APPARATUS

TECHNICAL FIELD

The present invention relates to a concrete leveling apparatus for performing the work of levelling a poured concrete surface when concrete floor surfaces and the like are being built.

BACKGROUND ART

When concrete floor surfaces and the like are being built, levelling the concrete to a smooth surface after it has been poured is conventionally performed manually by workers using trowels but not only is such manual work inefficient and involve much time, there are also many other problems such as a poor accuracy of leveling, and the difficulty of obtaining workers to perform it.

Because of this, efforts are being made to bring into practical application machines that automatically run across a poured concrete surface after it has been poured and before it has completely hardened and perform the leveling of the concrete.

However, such machines have wheels that run across the poured concrete and disturb the levelness of the surface and have another problem in that the weight of the machine is directly applied to the poured concrete surface and causes other problems of bending or otherwise damaging the steel reinforcement beneath the concrete surface.

DISCLOSURE OF INVENTION

The present invention is configured by a concrete leveler portion that is supported to a traveling unit that is driven by a screw and that is mounted so as to be freely movable along a traveling beam that travels along left and right rails, and that automatically performs the work of leveling the poured concrete surface without leaving any tracks in it.

In addition to this, the screw is configured by a main screw and an auxiliary screw so that surplus concrete is suitably discharged to portions of the surface that are still to be leveled.

Furthermore, a vibrator plate or a vibrator plate and trowel are provided to the screw so that leveling tracks caused by the screw are leveled out by the fine vibration.

Still furthermore, the height of the vibrator plate is automatically adjusted so that suitable leveling work is performed with respect to both horizontal or sloped surfaces.

Yet furthermore, the traveling beam has a self-operating structure that does not require the laying of rails.

BRIEF DESCRIPTION OF DRAWINGS

FIGS. 18 (A)–(H) are views describing the operation.

BEST MODE FOR CARRYING OUT THE INVENTION

The following is a description of embodiments of the present invention with reference to the appended drawings.

Figure 1:
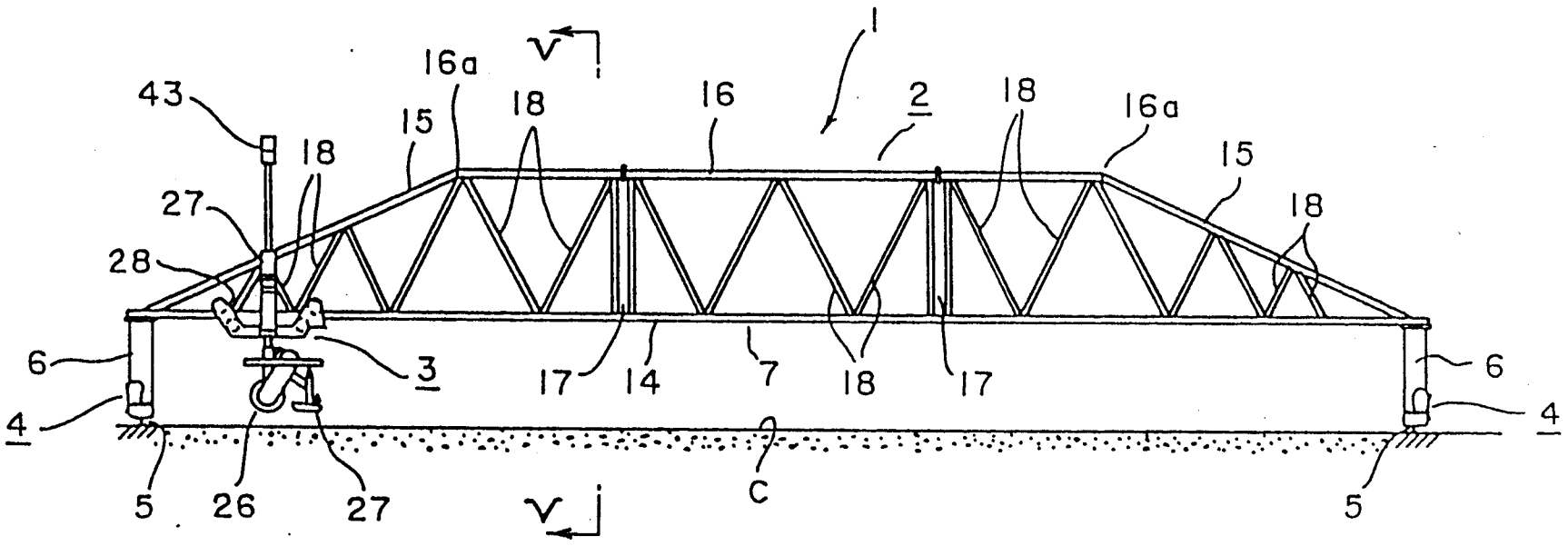
FIG. 1 is a frontal elevational view describing a first embodiment of the present invention.

The concrete leveling apparatus 1 comprises the traveling beam 2 and the concrete leveler portion 3 shown in FIG. 1, and the traveling beam 2 is provided with self-traveling drive portions 4, 4.

Figure 2:
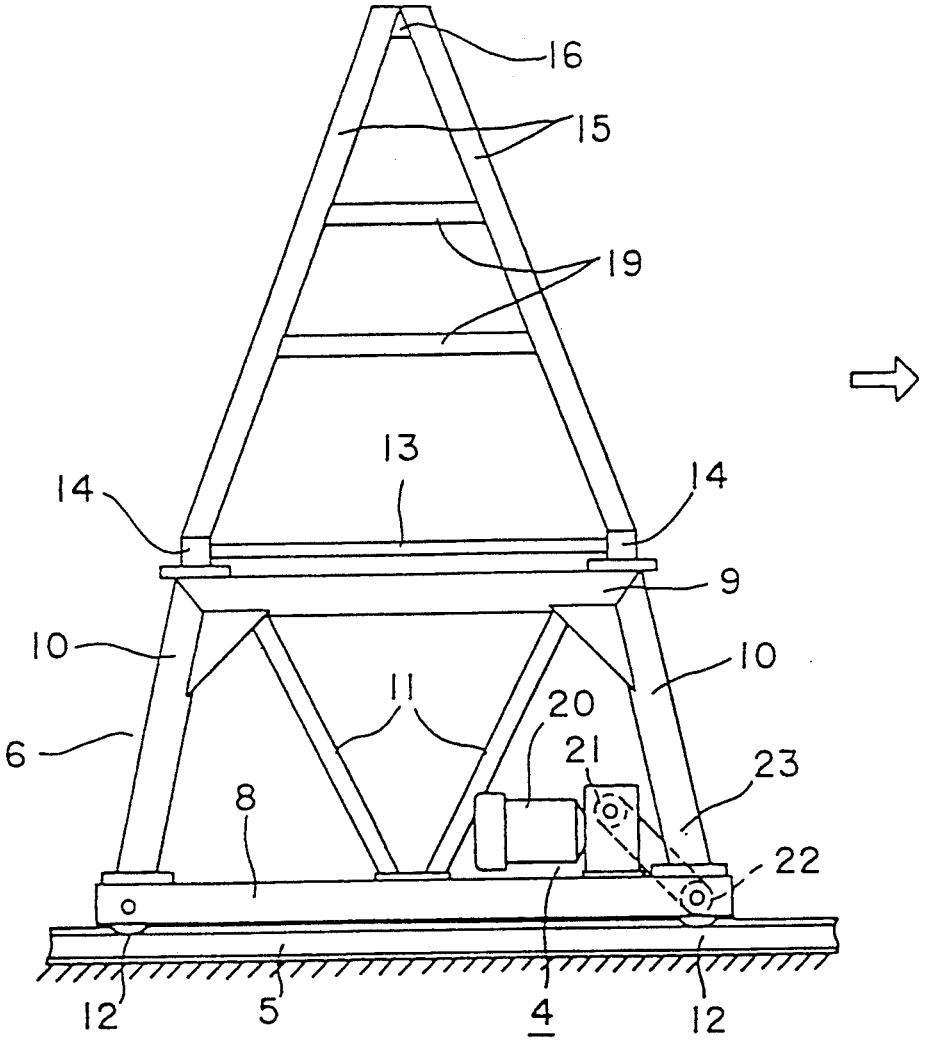
FIG. 2 is a side elevational view of a traveling beam.
Figure 3:
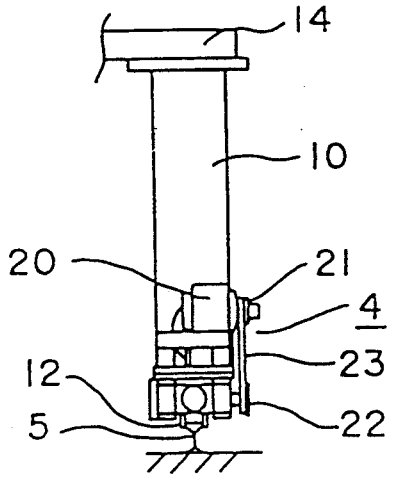
FIG. 3 is an enlarged frontal elevational view of the leg support portion shown in FIG. 2.

As shown in FIG. 1 through FIG. 3, the traveling beam 2 is configured from rails 5, 5 that are laid on both sides of the poured concrete surface C, traveling leg portions 6, 6 that are provided so as to correspond to the rails 5, 5, and beam 7 that spans the upper portion between these traveling leg portions 6, 6.

The traveling leg portions 6, 6 are each configured from a lower transverse member 8 provided parallel to the respective rail 5, and leg supports 10, 10 and reinforcing members 11, 11 that are fixed to form a trapezoid shape with an upper transverse member 9 which is slightly shorter than the lower transverse member 8, and to both ends of the lower transverse member 8 are provided rollers 12, 12 so that the traveling beam 2 can travel along the rail 5.

The beam 7 is configured from transverse beams 13, 13 that are provided to the top of the upper transverse members 9, 9 of the traveling leg portions 6, 6, and form a right-angled rectangle with lower cross beams 14, 14 that are provided so as to span between the transverse beams 13, 13, and which are also provided with end members 15, 15, 15, 15 that slope upwards from both end portions of the transverse beams 13, 13 to form triangular shapes. To the respective apexes of these triangular shapes are fixed an upper cross beam 16 that is parallel to the lower cross beams 14, 14, and which is provided with vertical braces 17, 17, 17, 17 that fix the upper cross beam 16 and the lower cross beams 14, 14 between the end portions **16*a*, 16*a* of the upper cross beam 16. In addition, a suitable number of diagonal braces 18, 18, 18,... are fixed between the end members 15, 15, 15, 15, the lower cross beams 14, 14 and between the upper cross beam 16 and the lower cross beams 14, 14, while cross struts 19, 19 are fixed so as to be parallel to the transverse beams 13, 13, between pairs of end members 15, 15**.

The drive portions 4, 4 of the running beam 2 are respectively provided to the upper portion of the lower transverse members 8, 8. More specifically, each of the drive portions 4, 4 is configured from a pulley 21 that engages with the shaft of a geared motor 20 that is mounted to the upper portion of the lower transverse member 8, and that has a belt 23 wound around a pulley 22 that engages with a shaft of a roller 12 of the lower transverse member 8.

The concrete leveler portion 3 is configured from traveling members 24, 24 that travel using the lower cross beams 14, 14 as the guide rails, a screw 26 that is illustrated as being in the form of an auger and which is supported by the traveling members 24, 24 via the raising and lowering jacks 25, 25 that function as the raising and lowering, and level adjustment mechanisms, and a vibrating plate 27.

To the traveling members 24, 24 are provided frames 28, 28 that sandwich the lower cross beams 14, 14 from both sides and perpendicular to these frames 28, 28 are provided a linkage member 29. Then an upper roller 30 and a lower roller 31 are provided as a pair to the frames 28, 28 so as to sandwich the lower cross beams 14, 14 from the top and bottom but two pairs are provided to one side in the interval and one of these pairs has the rotation of the roller drive motor 32 transmitted to it.

To both ends of the linkage members 29 are vertically provided raising and lowering jacks 25, 25 and to the distal ends of these raising and lowering jacks 25, 25 is coupled the frame 33, while underneath the frame is axially supported the screw 26. One pair of the raising and lowering jacks 25, 25 has the combined function of a height adjustment and level adjustment mechanism, and height adjustment is performed by simultaneous operation of both raising and lowering jacks 25, 25, while level adjustment is performed by selectively operating either one of the raising and lowering jacks 25, 25.

The height adjustment mechanism and the level adjustment mechanism can of course be performed using separate mechanisms. Also, the screw 26 has two screw blades 35 around the periphery of the screw shaft 34 and is covered from the front upper portion of the screw 26 to the rear lower portion by a cover 36. Furthermore, the rotational drive motor 37 of the screw 26 is mounted to the frame 33 so that the rotational force is transmitted from the motor 37 via the chain 38 to the screw 26. The chain cover is shown in the figure by the numeral 39.

To the side of the rear of the frame 33 is a vibrator plate 27 which is supported via arms 40, 40. This vibrating plate 27 has a length that is about the same as the screw 26 and to the central portion of this screw 26 is mounted a vibrator 41. The lower surface of the vibrating plate 27 is a smooth leveling surface 42 and the leveling surface 42 is positioned at substantially the same height as the lower end of the screw 35.

Moreover, to the end portion of the frame 33 is provided a laser light receiver 43 that receives the laser light 1 that is emitted from the laser light emitter (not shown in the figure) at a planned height, and to the central portion of the frame 33 is provided a slope angle detector 44.

Figure 6:
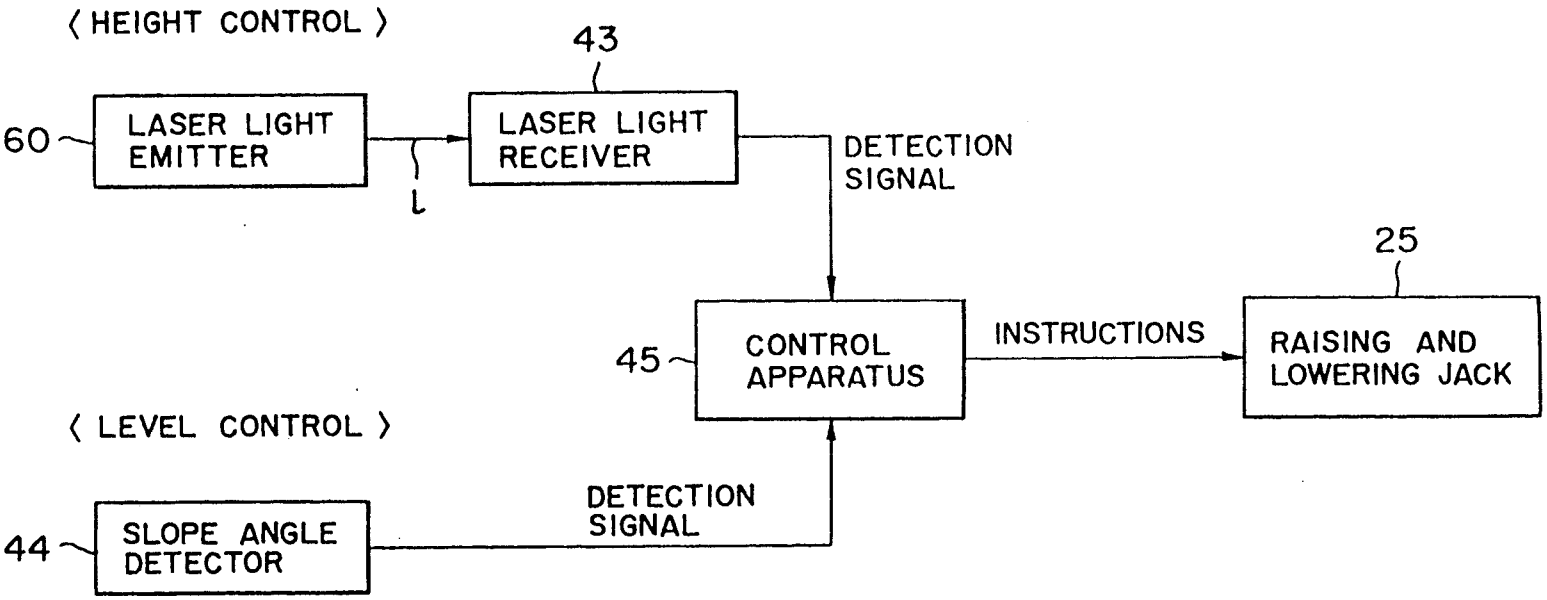
FIG. 6 is a view of the configuration of the control system.

FIG. 6 shows the control system for controlling the level and the height of the concrete leveler portion 3 while leveling work is in progress.

Height control is performed by the laser light receiver 43 detecting the height of the concrete leveler portion 3 from the laser light 1 received from the laser light emitter 60 which emits the laser light at a planned height, while level control is performed by detecting the level of the concrete leveler portion 3 from the slope angle detector 44 and inputting the respective control signals to the control apparatus 45.

The control apparatus 45 performs comparison calculation between the input values for the height and the slope angle and values that have been set beforehand, and the results of this calculation are used as the basis for sending instructions for extension and contraction operation to the raising and lowering jacks 25, 25.

The following is a description of the operation of the embodiment described above.

Concrete is poured to a floor or the like and while the poured concrete is still in the unhardened status, the raising and lowering jacks 25, 25 are operated so that the screw 26 is lowered via the frame 33 of the concrete leveler portion 3, and when the lower end of the screw blade 35 is positioned at the position of the planned level surface, the leveling surface 42 of the lower surface of the vibrating plate 27 is also set to the same height position.

Figure 4:
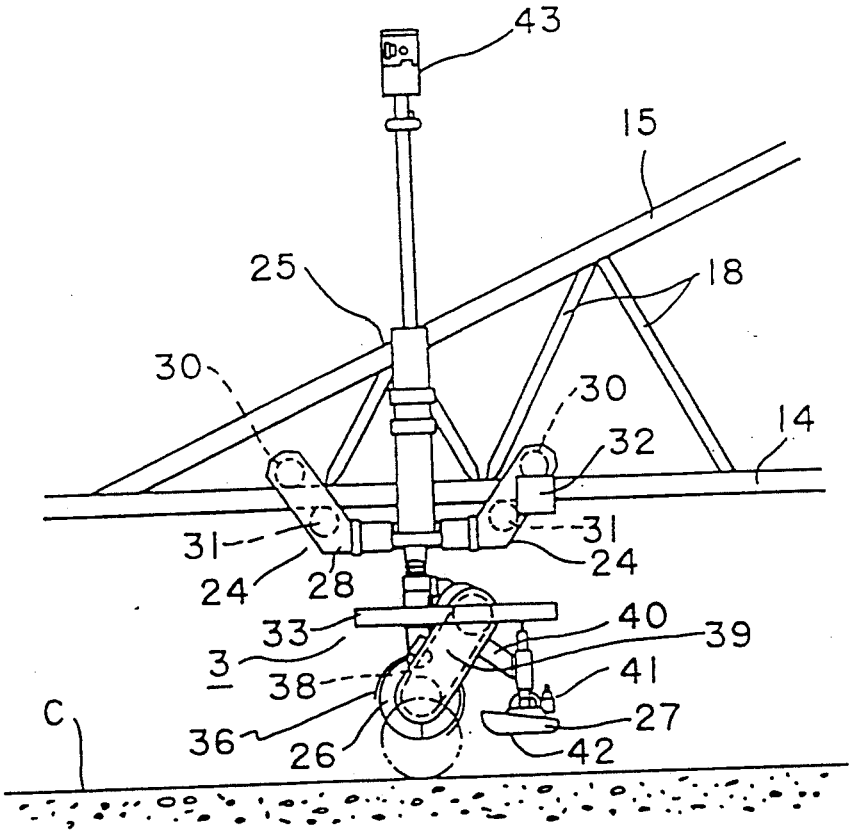
FIG. 4 is an elevational view of a concrete leveler portion.

Then, the rotational drive motor 37 of the screw 26 starts and at the same time as when a rotational force is applied to the screw 26, the vibrator 41 also starts and the concrete leveler portion 3 travels along the traveling beam 2 so that the screw 26 and the vibrating plate 27 smooth the surface of the concrete to a flat surface. When the leveling of the concrete surface at that position is finished, the geared motors 20, 20 start and the traveling beam 2 is moved by a predetermined distance in the direction indicated by the white arrow, and stops there, and the concrete leveler portion 3 again travels and performs leveling in the same manner as has already been described above. At this time, any surplus concrete is discharged to the direction of the left in FIG. 4 or the direction of the left in FIG. 5 (the leveling direction) by the action of the screw blade 35. After this, the concrete surface has the leveling tracks caused by the screw 26 removed by the leveling surface 42 because of the vibration in the up and down direction of the vibrating plate 27, and the surface is made a completely smooth surface. In addition, if the surplus concrete is discharged to the direction of the right in FIG. 5, then the screw 26 can be rotated in the direction of the left in FIG. 4.

While the operation described above is taking place, the level and the height of the concrete leveler portion 3 is continuously detected by the laser light receiver 43 and the slope angle detector 44 and those converted signals are input to the control apparatus 45, comparison calculations are performed between those values and values that have been set beforehand, and when a difference of outside an allowable range occurs between the two, the control apparatus 45 immediately sends an operating instruction to the raising and lowering jacks 25, 25 so that the concrete leveler portion 3 is returned to a rated posture.

In the embodiment described above, the raising and lowering mechanism need not be raising and lowering jacks, and can be a mechanical means of a link mechanism or the like. Also, the drive portion of the traveling beam is shown for the case when it used pulleys and belts but it can also use a sprocket and chain, while the drive of the concrete leveler portion can use a roller and a guide rail but a rack can be formed to the lower cross beam and a combination of this and a pinion used. The drive portion is not limited to these however.

Therefore, according to the present embodiment, a concrete leveling portion is provided to the traveling beam that travels on rails that are laid on both sides of the poured concrete surface and so the traveling wheels do not travel directly upon the poured concrete surface and thus it is possible to level the concrete surface without disturbing it and without damaging the reinforcing rods beneath the poured concrete surface. In addition, it is possible to maintain a constant leveling level for the concrete leveling portion because of the rails that are laid on both sides of the poured concrete surface.

Not only this, as in the case of the present embodiment, if a mechanism to detect the height and the level of the leveling portion and to perform automatic compensation is provided, then it is possible to obtain a level surface having good accuracy.

Figure 7:
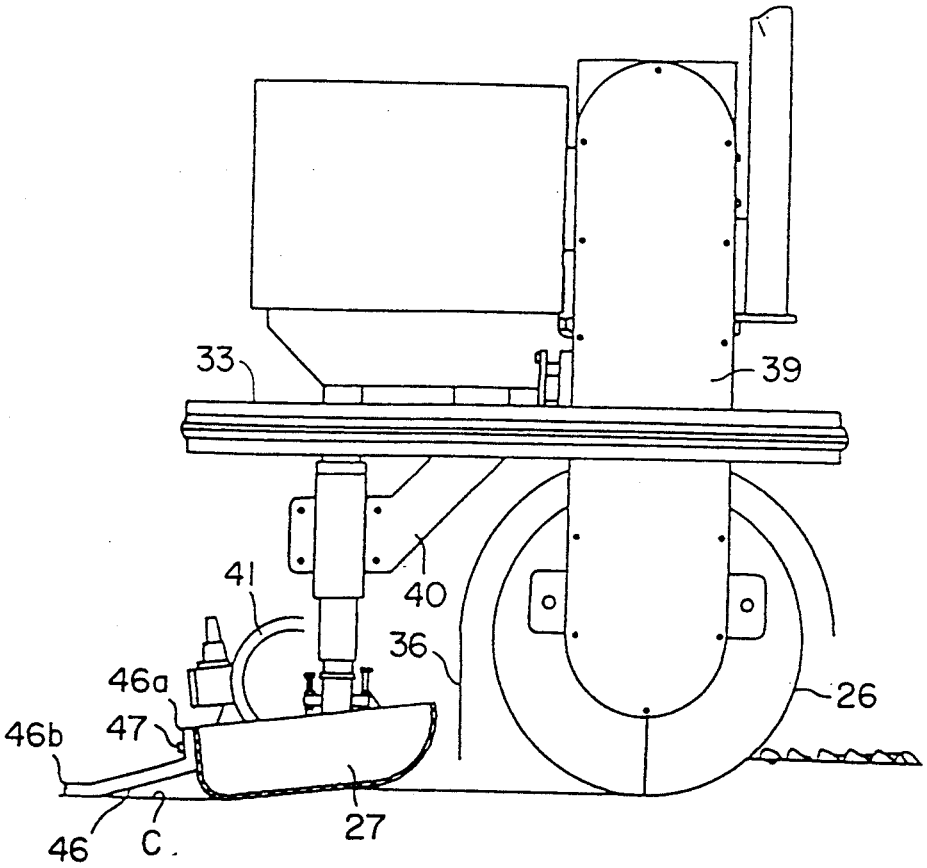
FIG. 7 is an enlarged elevational view of the leveler portion shown in FIG. 1.
Figure 8:
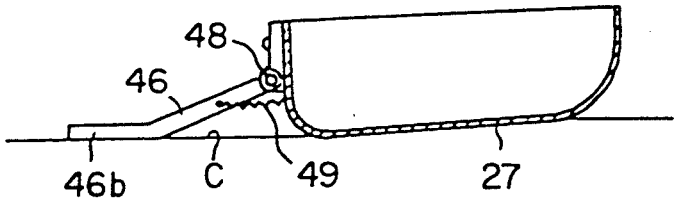
FIG. 8 is an elevational view showing another embodiment of the trowel plate shown in FIG. 7.

FIG. 7 and FIG. 8 show an embodiment that can perform compaction of aggregate and leveling of the poured concrete surface and that can also smoothly finish the surface and the level of the concrete without there being any disturbances.

More specifically, there is a compactor plate 46 provided to the vibrating plate 27 on its rear side with respect to the direction of travel. This compactor plate 46 is comprised of a flexible plate material such as hardened rubber or the like, and as shown in FIG. 7, the base portion 46*a* is mounted by a bolt 47 or the like to the surface on the side of the rear of the vibrating plate 27 and the surface of the lower side of the distal end 46*b* is set to a height so that it does not bounce from the poured concrete leveling surface C even if the vibrating plate 27 moves up and down, and so that the lower surface on the side of the distal end 46*b* is in flexible contact with respect to the set level for the poured concrete leveling surface C.

Moreover, the means of applying flexibility to the compactor plate 46 can be the flexibility inherent to the material of the mechanism as described above, but as shown in FIG. 8, can also be due to the compactor plate 46 being configured from a rigid material such as metal or synthetic resin, and having the base portion of the compactor plate 46 mounted so as to be movable in the up and down direction by a hinge 48 at the rear portion of the vibrating plate 27, and so that the lower surface on the side of the distal end 46*b* of the compactor plate 46 is urged by a hinge 49 so that it is urged in the downwards direction and is always in contact with the poured concrete leveling surface C.

The vibrator means 41 can use an eccentric motor or the like.

By this, after there has been leveling by the screw, the surface of the concrete is leveled to the leveling surface C by the up and down vibration of the vibrating plate 27, and aggregate that has risen to the surface is made to sink. After this, the compactor plate 46, in constantly pressing against the leveled concrete surface C, enables the concrete surface that has disturbed by the motion of the vibrating plate 27 to be finished to a smooth surface. Accordingly, the up and down motion of the vibrator plate 27 sinks the aggregate at the same time as it levels the leveling tracks made by the screw, and the concrete surface is then compacted by the compactor plate so that it is possible to level the poured concrete surface and then both sink the aggregate and level the surface, and to also level out any disturbances caused by the vibrator plate, thus making the use of other finishing machines unnecessary.

Figure 9:
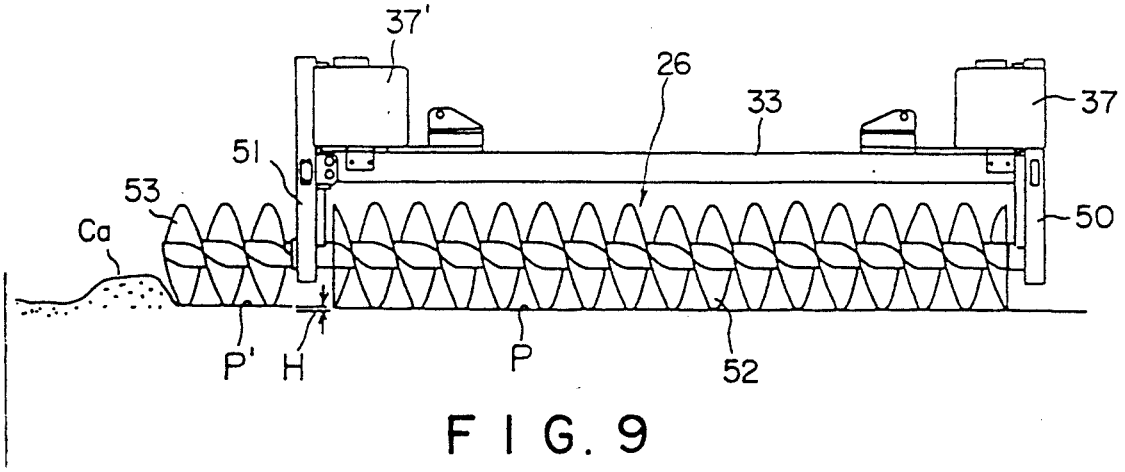
FIG. 9 is a frontal elevational view of the main portions of the other embodiment.
Figure 10:
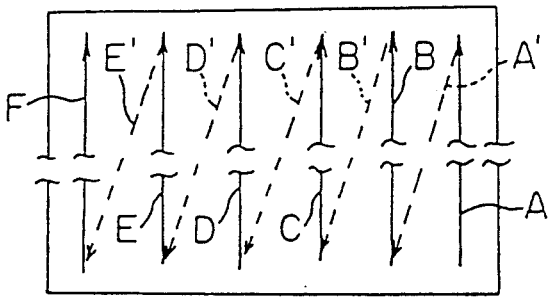
FIG. 10 and FIG. 11 are views describing the procedure for performing the leveling work.
Figure 11:
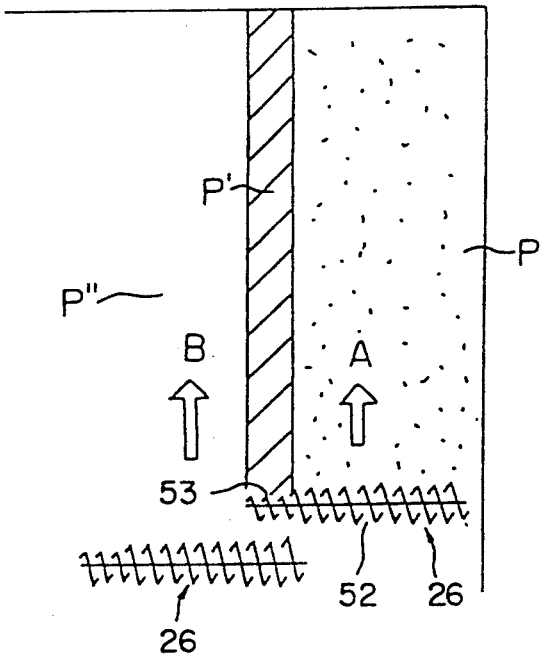

FIG. 9 through FIG. 11 show the case when a conventional leveling apparatus is used to perform the supply to a certain height (a height suitably higher than the leveling height), of concrete by manual or some other means to the area of the concrete that is to be leveled next, while leveling work is being performed in parallel, but conventionally, this leveling work is performed by workers and so there often occur surpluses and insufficiencies in the amount of concrete that is to be poured to the next area where leveling work is to be performed and there are often cases where this presents an obstacle to leveling to a uniform leveling height.

Also, while the leveling work is being performed, the screw causes surplus concrete collects at the end on the side of concrete discharge and this concrete collapses into the leveled surface after the leveling work has been performed, and thus causes the problem of lowering the work efficiency since re-leveling has to be performed.

With respect to these problems, the present embodiment is able to perform the suitable supply of concrete to the area that is to be leveled next, and also has no collecting of surplus concrete.

More specifically, as shown in FIG. 9, the main screw 52 for concrete levelling is axially supported between the support legs 50, 51 to the left and the right of the frame that is supplied by the traveling unit 24, and the auxiliary screw 53 is axially supported on the outside on one side of the support leg 51. In the figure, 37 is a main screw drive motor and 37' is an auxiliary screw drive motor.

In this embodiment, the main screw 52 and the auxiliary screw 53 are coaxial and the diameter of the auxiliary screw 53 is smaller than the diameter of the main screw 52, and there is a leveling height difference H (of 5 to 30 mm) between the main screw 52 and the auxiliary screw 53. In this case, the diameter of the auxiliary screw 53 can be either the same or different from that of the main screw 52 and the position of axial support to the support legs 51 can be different from the axial line of the main screw 52 so that the leveling height difference H can be made. The following is a description of the operation of this embodiment.

When the main screw 52 and the auxiliary screw 53 are driven and rotated and the traveling unit 24 is moved in the direction indicated by the arrows in FIG. 10 and FIG. 11, the poured concrete surface is leveled by the rotation of the main screw 52 and the surplus concrete Ca is sent to the side of the auxiliary screw 53. This concrete that is sent from the end portion of the main screw 52 is continually sent further in the direction of the outer end by the auxiliary screw 53. When this is done, the height of the leveled surface P' due to the auxiliary screw 53 is higher by the amount H, than the height of the concrete leveling surface P due to the main screw 52. Accordingly, if the height of the leveling surface P' due to the auxiliary screw 53 is used as the reference when there is the supply of concrete to the next object area P" while this leveling work is being performed, then there will be no over- or under-supply in the amount of concrete.

In this manner, when the traveling unit 24 has come to the end of the direction indicated by the arrow A, it is lifted from the concrete leveling surface and as shown by the arrow A' in FIG. 10, is returned to the start position while it is moved on the beam 7 to the side of the next object area P" (to the left in FIG. 11) by an amount equivalent to the length of the shaft of the main screw 52, and if the traveling unit 24 is moved in the direction indicated by the arrow B in the same manner as described above, the concrete that is supplied to this area P" is leveled as described above, along with the leveling surface P' that has already been leveled by the auxiliary screw 53, and the surplus concrete is leveled in the next object area by the auxiliary screw 53.

In this manner and as shown in FIG. 10 at points (C) through (F), it is possible to repeat return work so that there is leveling to a uniform height for the entire surface.

Moreover, the auxiliary screw 53 is desirably provided so that it protrudes to the outer side of the support leg 51 so that surplus concrete does not collect on the inside of the support leg 51 but when there is only a relatively small amount of concrete to be poured, it is possible to position the auxiliary screw 53 so that it is on the inside of the support leg 51. In addition, if the auxiliary screw 53 can be removed, then it is possible to exchange it with an auxiliary screw having a different diameter and therefore possible to use the main screw 52 to perform leveling up to wall surfaces. Also, it is possible for the auxiliary screw 53 to be provided so that it is either to the forward side or the rearward side of the line of the axis of the main screw 52.

Therefore, according to this embodiment, the work of supplying the concrete to the next area for leveling can be performed using the height of the surface leveled by the auxiliary screw as a guide so that there is no over- or under-supply in the amount of concrete supplied and so that the leveling work is performed quickly and favorably. In addition, surplus concrete does not collect at the end portion of the main screw and so it is possible to raise the efficiency without there being any disturbances in the leveled surface due to the collapse of surplus concrete onto the surface that has already been leveled by the main screw.

FIG. 12 through FIG. 15 are of an embodiment that enables automatic control of the level of the apparatus even if leveling work is being performed on a sloped surface, and has a laser light receiver 43 that receives laser light emitted from a laser light emitter (not shown in the figure), at a planned leveling height, and to the central portion of the frame 33 is provided a slope angle detector 44.

Figure 12:
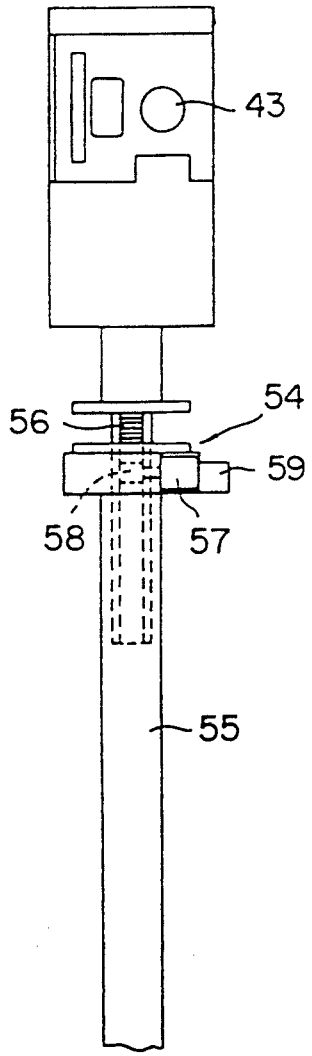
FIG. 12 is a frontal elevational view showing one example of the mechanism for moving the laser light receiver up and down.
Figure 13:
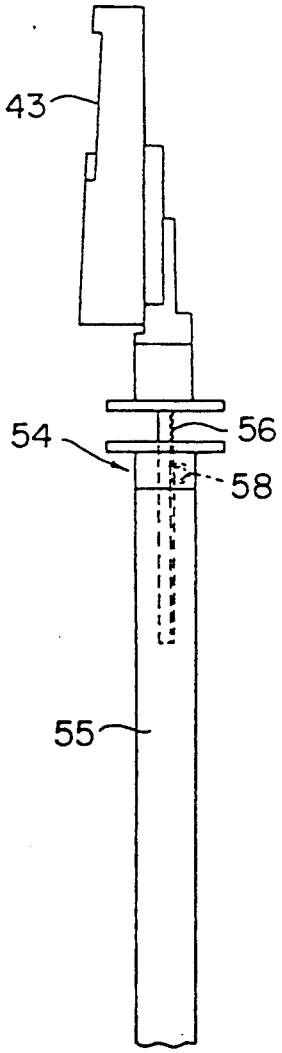
FIG. 13 is a side elevational view of the mechanism for moving the laser light receiver up and down.

The laser light receiver 43 is raised and lowered by an up and down motion mechanism 54 as indicated in FIG. 12 and FIG. 13. The up and down motion mechanism 54 has a rack 56 inserted vertically into the lower portion of the laser light receiver 43 and is vertically supported at the upper end of the support 55 standing upright in the frame 33, and this rack 56 engages with a pinion 58 that is rotated by the motor 57, thereby enabling the laser light receiver 43 to be moved up and down by the drive of the motor 57.

Figure 14:
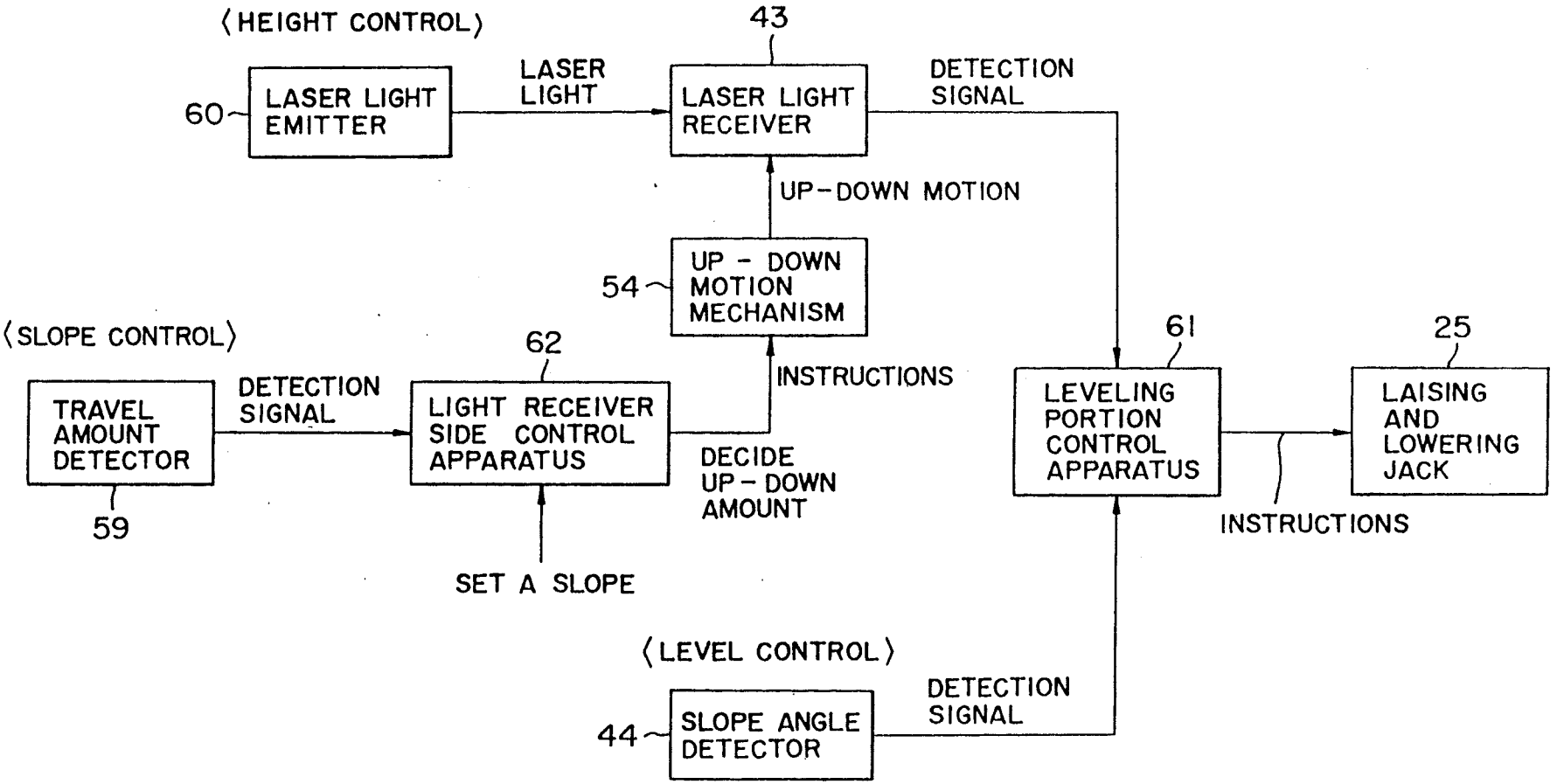
FIG. 14 is a block diagram of the control system.
Figure 15A:
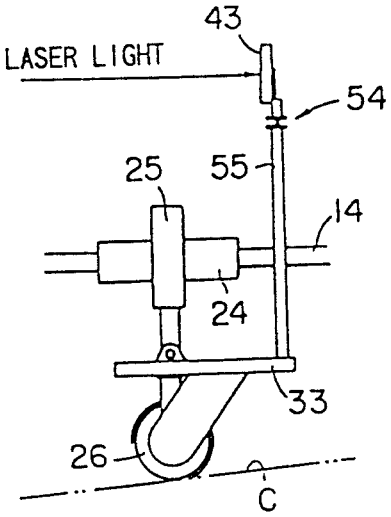
FIGS. 15 (A)–(D) are views describing the operation.
Figure 15B:
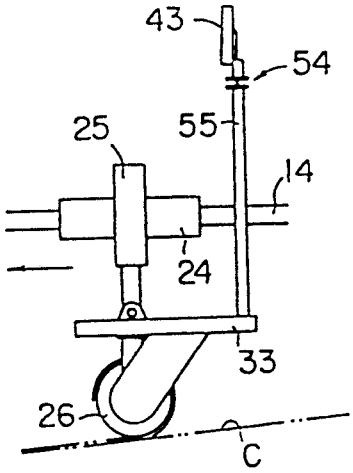
Figure 15C:
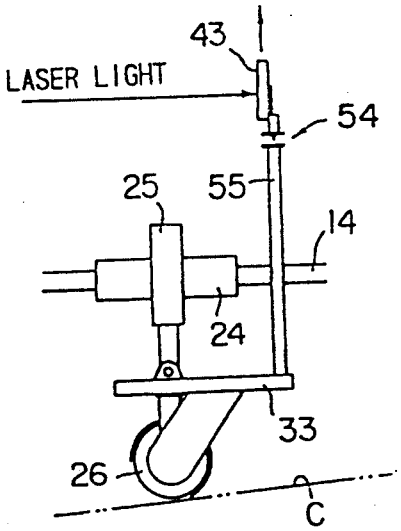
Figure 15D:
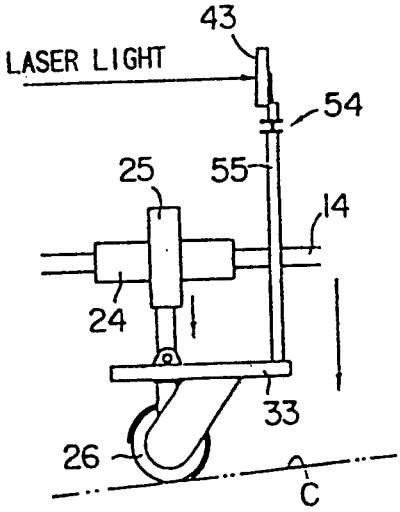

FIG. 14 shows the control system so that the height and the level of the concrete leveling portion 3 can be made constant while leveling work is being performed.

Height control is performed by receiving the laser light that has been emitted at the planned height from the laser light emitter 60 and detecting the height of the concrete leveling portion 3, while level control is performed by using the slope angle detector 44 to detect the level of the concrete leveling portion 3 and to input the various detection signals to the leveling portion control apparatus 61. Furthermore, slope control is performed by using the travel amount detector (encoder 59) to detect the amount of travel and input it to the light receiver side control apparatus 62, while the vertical displacement of the laser light receiver 43 is determined by comparison calculation with a set value for the slope, and by operating the up and down motion mechanism 54 to raise and lower the laser light receiver 43.

The control apparatus 61 performs a comparison calculation of the input values for the slope angle and the height and the values that have been set beforehand, and uses the results of this calculation as the basis for giving extension and contraction operation instructions to the raising and lowering jacks 25, 25.

The following is a description of the operation of this embodiment.

At the time of commencement of the levelling by the concrete leveler portion 3 after the concrete of the floor surface or the like has been poured and while it is still in the unhardened status, the raising and lowering jacks 25, 25 that form the up and down adjustment mechanism and the level adjustment mechanism operate so that the concrete leveler portion 3 is at a rated height and posture, and then while there is this status, the height position of the laser light receiver 43 is adjusted by the up and down movement mechanism 54 so that laser light that has a required height and which is emitted from the laser light receiver 43 is received by the laser light receiver 43. When this has been completed, the concrete leveler portion 3 is driven and at the same time, the traveling members 24, 24 that has the concrete leveler portion 3, travels at a constant speed on the traveling beam 2 and the leveling work starts ((A) of FIG. 15).

At the same time as when the drive force of the concrete leveler portion 3 is applied to the screw 26 by starting the rotational drive motor 37 of the screw 26, the vibrator 41 starts operation and the concrete leveler portion 3 travels along the traveling beam 2 so that the screw 26 and the vibrating plate 27 smooth the concrete surface to a smooth surface.

After this, the vibration in the up and down direction of the vibrating plate 27 smooths the concrete surface C so that leveling tracks due to the screw 26 are removed and so there is leveling to a perfectly smooth surface.

Along with the traveling of the concrete leveler portion 3 ((B) of FIG. 15), the encoder 59 which is the travel amount detection portion detects the amount of travel (distance of displacement) of the concrete leveler portion 3 and, at the same time, the value for the travel amount of the concrete leveler portion 3 and which has been obtained from the light receiver control apparatus 62, and the value that has been set beforehand for the slope are used as the basis for calculating the amount of up and down movement of the laser light receiver 43, and the laser light receiver 43 is then moved up and down on the basis of the value calculated. When the laser light receiver 43 moves up and down, the point at which the laser light emitted at a required height is received by the laser light receiver 43, is displaced ((C) of FIG. 15) and the control apparatus 61 immediately performs a comparison calculation between the value detected by the laser light receiver 43 and the value that has been set beforehand and these calculation results are used as the basis for operating the raising and lowering jacks 25, 25 of the up and down movement mechanism and positioning the concrete leveler portion 3 so that the laser light receiver 43 is always at a position of constant height ((D) of FIG. 15). The posture of the concrete leveler portion 3 is adjusted by a comparison calculation being made between the value for the slope angle of the concrete leveler portion 3 and which has been detected by the slope angle detector 44, and a value that has been set beforehand, and the results of that calculation being used as the basis for operating the raising and lowering jacks 25, 25 which are the level adjustment mechanism.

According to this embodiment, it is possible to perform leveling work to a slope value and for concrete leveling on sloped surfaces to be performed automatically and accurately.

Figure 16:
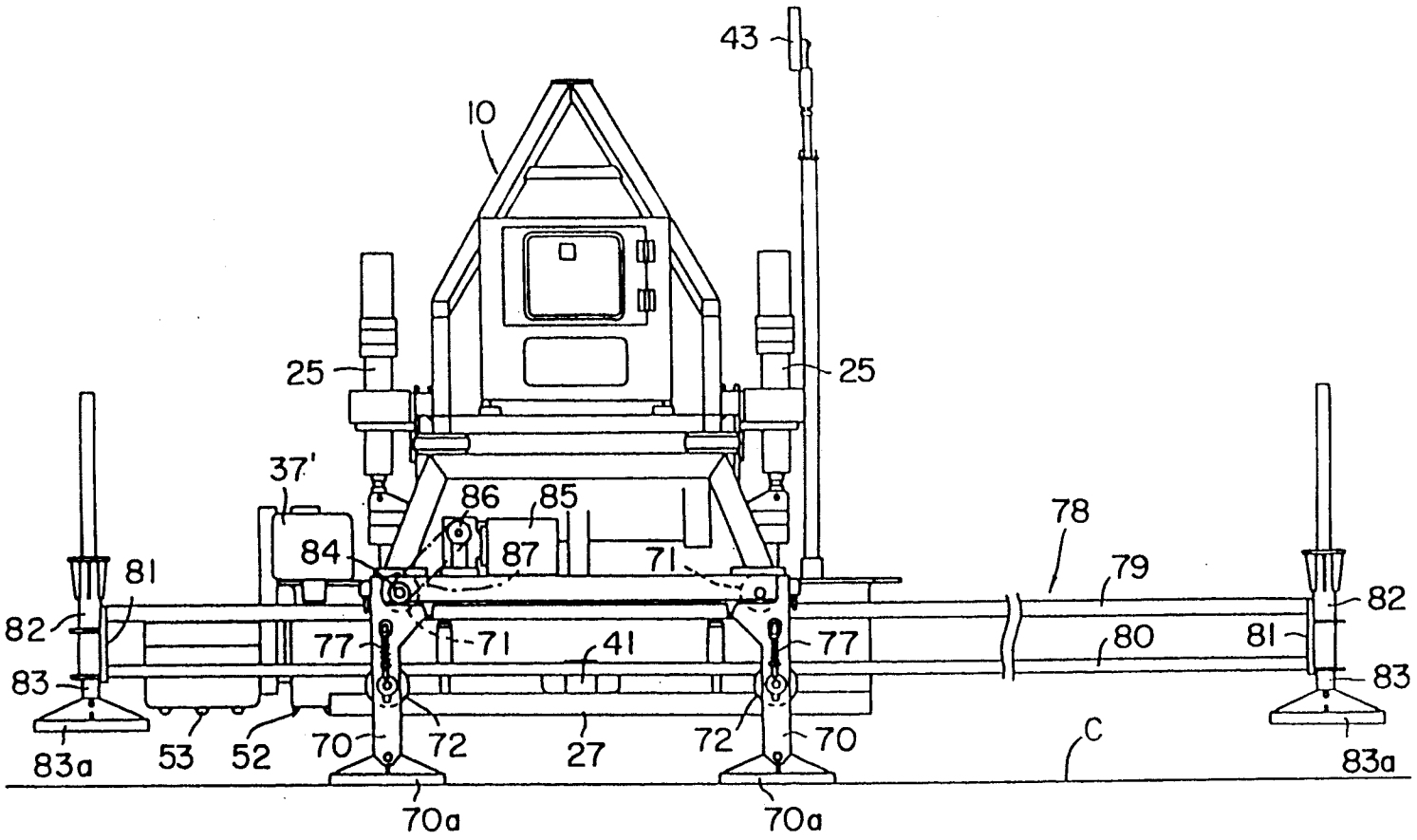
FIG. 16 is a frontal elevational view showing another embodiment of the present invention.
Figure 17:
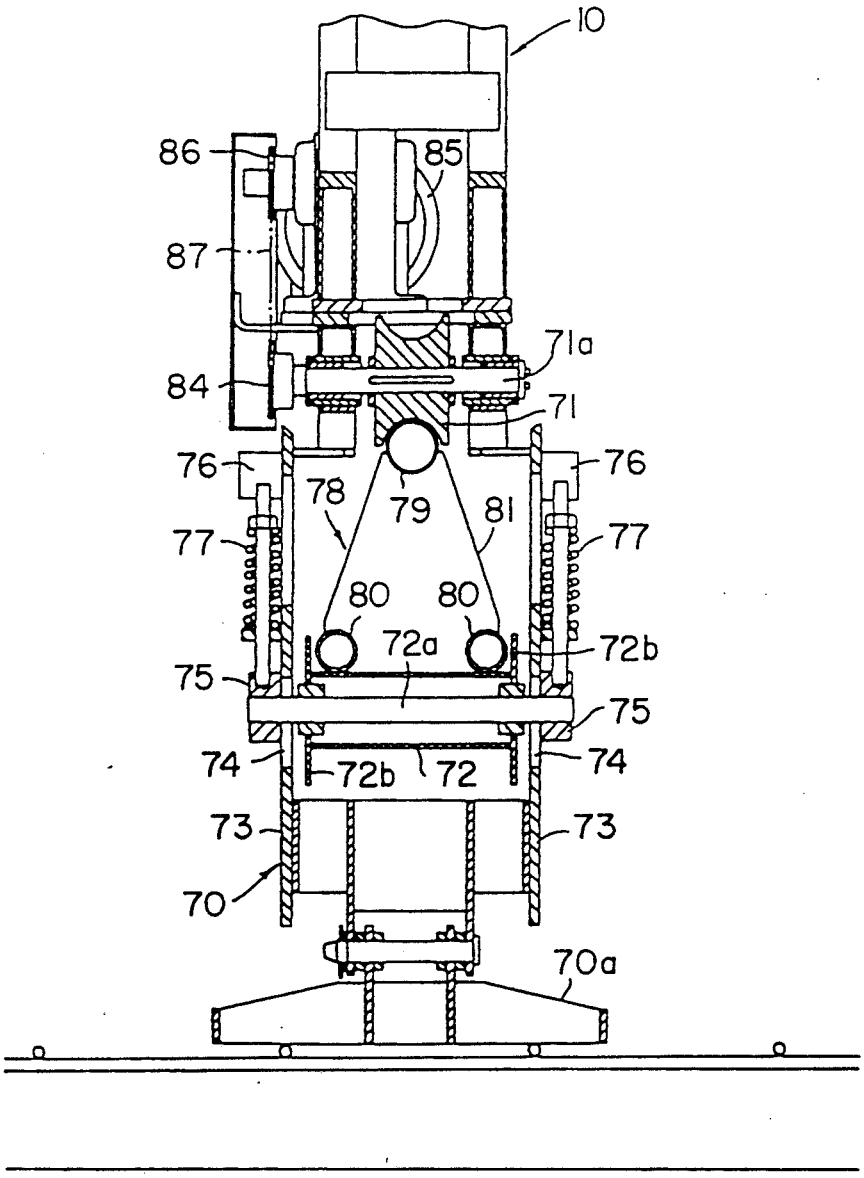
FIG. 17 is an enlarged sectional view of the leg portion shown in FIG. 16.

FIG. 16 through FIG. 18 show an embodiment that successively sends rails so as to make the concrete leveling apparatus traveling and move.

In the embodiments described above, the rails 5, 5 along which the traveling beam 2 travel were laid beforehand for along the entire length on both sides of the poured concrete surface and so it was not possible to avoid unleveled portions for these rail portions 5, 5 and the vicinity of them. Because of this, it was not possible to completely eliminate later manual leveling work for these rail portions.

Not only this, leaving the rails in place creates obstacles for later finishing work and so unleveled portions would remain if the rails were simply left in place. Therefore, it was necessary for the rails to be dismantled and removed for those portions where the leveling work had been completed, and for those tracks to be leveled by manual labor afterwards. Because of this rail removing work that has no direct relationship with the leveling work, it was necessary to have workers constantly present, and this caused the problem of an insufficient labor and energy saving.

In order to eliminate this problem, the work of removing the rails by manual labor is eliminated and the energy saving effect of mechanical work is increased further.

A traveling beam 10 has the same configuration as in the embodiment described above, and to the lower portion of both ends of its beam 7 are vertically provided two legs 70, 70 on each side, and the lower ends of these legs 70, 70 are provided with pads 70*a*, 70*a* that are in stable contact with the poured concrete surface C.

To the end portion on both sides of the traveling beam 10 are axially mounted upper portion rollers 71, 71 as shown in FIG. 16, and to the legs 70, 70 at the lower portion are axially supported lower portion rollers 72, 72. As shown in the enlarged sectional view FIG. 17, these lower portion rollers 72, 72 are formed with a shaft 72*a* of the lower portion rollers 72, 72 inserted into the long hole that is opened lengthways in the up and down direction in the side walls 73, 73 on the left and right sides of the leg 70, thereby making these lower portion rollers 72, 72 movable in the up and down direction. Springs 77, 77 that have a tension action between the blocks 76, 76 fixed to the top of the leg 70 and the blocks 75, 75 of the end portion of this shaft 72*a* are placed and the lower portion rollers 72, 72 is always urged in the upwards direction, and the rail 78 is held between these upper and lower rollers 71, 72.

The rail 78 consists of an upper pipe 79 and two lower pipes 80, 80 that are fixed by support plates 81, 81 in the shape of an isosceles triangle when seen from the end surface, and the upper pipe 79 engages with the groove in the direction of the peripheral surface of the upper roller 71, and the lower pipes 80, 80 are housed in between the flanges 72*b* , 72*b* of the lower roller 72.

To the front and rear end portions of this rail 78 are attached jacks 82, 82 in the vertical direction, and to the lower end of the rams 83, 83 of these jacks 82, 82 are provided pads 83*a*, 83*a* that are in stable contact with the ground surface. These jacks 82, 82 are extended and contracted by the rams 83, 83 that are either electrically or hydraulically driven.

The upper roller 71 has its drive mechanism consisting of a sprocket 84 that is fixed to the end portion of its shaft 71*a* and a drive sprocket 86 for the motor 85 mounted to the traveling beam 10 and has a chain 87 placed so that the upper roller 71 rotates by the drive of the motor 85. Moreover, this transmission mechanism can be a system of gears instead of the chain 87. In addition, the upper and lower rollers 71, 72 that are the sending means can be pinions instead of the roller that is shown in the figure, and the rack on the side of the rail 78 can be formed so as to function as the sending mechanism and the holding mechanism for the rail 78. Other sending mechanisms can be formed by cylinders and chains and the like.

The concrete leveler portion 3 is provided with the screw 26 shown in FIG. 9, and is also provided with the vibrating plate 27.

Figure 5:
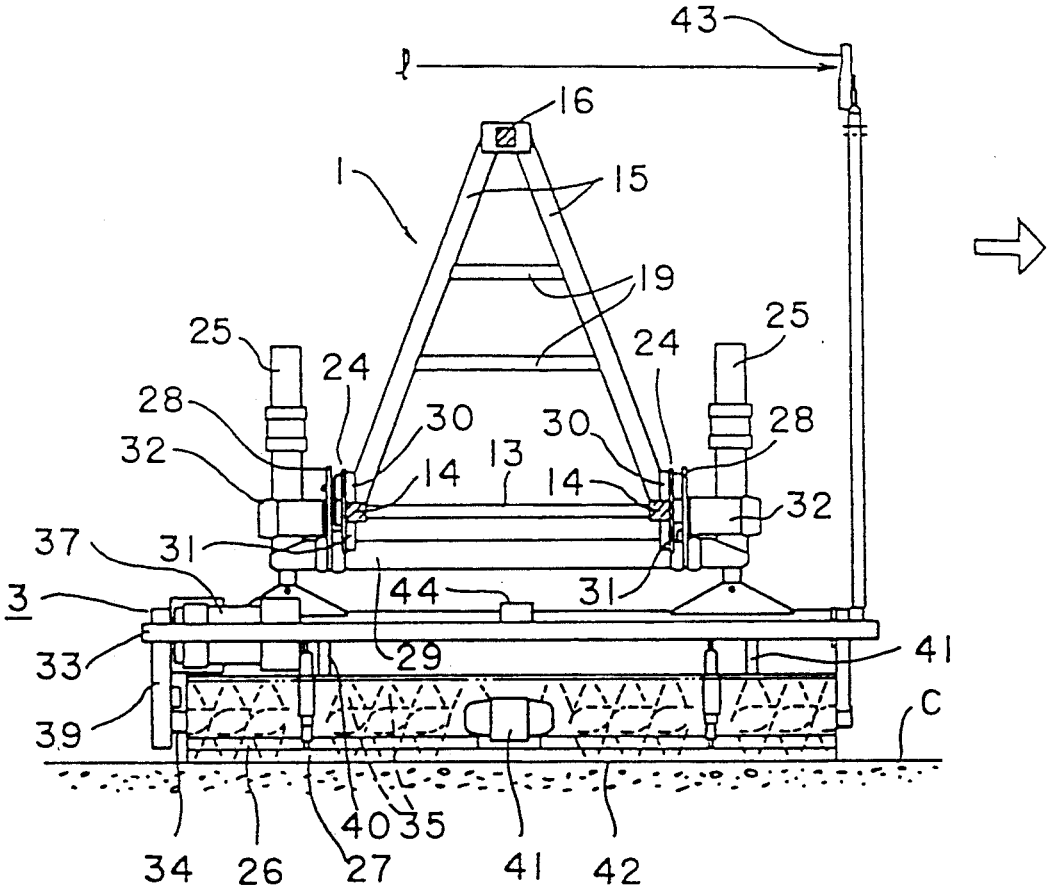
FIG. 5 is a sectional view along section lines A—A of FIG. 1.

In FIG. 16, those portions of the configuration that correspond to portions of FIG. 5 are indicated with corresponding numerals, and the corresponding descriptions of them are omitted.

The following is a description of the embodiment described above, with reference to FIG. 18 (A) through (H).

The jacks 82, 82 of the rail 78 contract and bring the legs 70, 70 of the traveling beam 10 into contact with the ground.

When this occurs, at the time of the start of leveling, the raising and lowering jacks 25, 25 that are the up and down adjustment mechanism and the level adjustment mechanism operate so that the concrete leveler portion 3 is adjusted to the rated position and the rated posture.

When this adjustment is completed, the concrete leveler portion 3 is driven and travels from one end of the traveling beam 10 to the other end and performs the work for leveling the poured concrete surface C ((A) of FIG. 18).

When the concrete leveler portion 3 has come to the other end, the jacks 82, 82 of the rail 78 are extended and the pads 70*a* , 70*a* rise ((B) of FIG. 18) and the motor 85 of the traveling beam 10 is driven so as to drive the upper roller 71 and the rotation of this upper roller 71 moves the traveling beam 10 by a single pitch portion ((C) of FIG. 18).

Then, the jacks 82, 82 of the rail 78 are again brought into contact with the ground ((D) of FIG. 18) and the traveling members 24, 24 travel and the leveling of the poured concrete surface C is again performed.

As shown in (E) to (F) of FIG. 18, when the traveling beam 10 has reached the end of the rail 78, the jacks 82, 82 of the rail 78 are contracted, then if the motor 85 is driven as soon as the pads 70*a* , 70*a* are brought into contact with the ground ((G) of FIG. 18), the upper pipe 79 that is pressed against the upper roller 71 by the springs 77, 77 is sent by the force of that friction and the rail 78 is sent in the forward direction as shown in (H) of FIG. 18.

This status is the same as the status shown in FIG. 18 (A) for when the leveling work commenced, and after this, the operation shown in FIG. 18 (B) through (H) is again repeated and the work of leveling the poured concrete surface C continues.

The action of the concrete leveler portion 3 is such that the drive motors 54, 55 of the screws 52, 53 are started so that at the same time as when the rotation force is applied to the screw, the vibrator 41 is also started and the concrete leveler portion 3 is made to travel along the traveling beam 10 so that the screws 52, 53 and the vibrating plate 27 smooth the concrete surface to a flat status.

When this occurs, surplus concrete is discharged in the direction of the left in FIG. 16 (the direction of leveling) by the action of the screw blade. After this, leveling tracks caused by the screw in the level surface are removed by the up and down vibration of the vibrator plate 34, and the concrete surface is made completely flat and smooth.

The legs 70, 70 of the traveling beam 10 can be jacked and replaced by the jacks 82, 82 of the rail 78, which do not extend and contract.

According to this embodiment, the work for the removal of the rails is not as it was conventionally, and it is possible for the energy saving effect due to mechanization to be exhibited to its fullest, and also for the work of laying the rails prior to the day of execution of the work to also become unnecessary and therefore represent a further raising of the work efficiency. Furthermore, when the length of execution of concrete pouring work is 100 m, this conventionally involved about fifty 4 m rails but only two rails are used with this embodiment and so this means a large reduction in the accompanying transportation costs.

INDUSTRIAL APPLICABILITY

As has been described above, the concrete leveling apparatus according to the present invention enables the work of leveling a poured concrete surface to be performed for the floors of high-rise buildings, rooftops, the floors of gymnasium facilities, outdoors and other large areas.

We claim:

1. A concrete leveling apparatus, comprising rails positioned on opposite sides of a poured concrete surface, a traveling beam that spans said rails and is adapted for travel in a direction of travel along said rails, a traveling unit that is movably mounted on said traveling beam and is adapted for travel along said traveling beam in a direction of travel perpendicular to the direction of travel of said traveling beam, and a concrete leveler portion supported by said traveling unit, an adjustment mechanism for adjusting and leveling said concrete leveler portion, said concrete leveler portion including a slope angle detector and a laser light receiver that receives laser light emitted at a planned height, and a control apparatus that compares a value of a slope angle and height of said concrete leveler portion detected by said laser light receiver and slope angle detector with predetermined values and said control apparatus including means for controlling said adjustment mechanism based on the comparison such that said adjustment mechanism adjusts said concrete leveler portion with respect to the poured concrete surface.

2. The concrete leveling apparatus of claim 1, wherein said concrete leveler portion is provided with a travel amount detector that detects a distance of relative motion with respect to said traveling beam, and displacement means for moving said laser light receiver up and down with respect to said concrete leveler portion, and a light receiver control apparatus that includes means for using a displacement amount of said concrete leveler portion that has been detected by said travel amount detector and a value of a predetermined angle as the basis for calculating an up or down displacement amount of said laser light receiver, and which also includes means for using said calculated value as a basis for moving, with said displacement means, said laser light receiver the calculated up or down displacement amount, and said light receiver control apparatus also including means for performing a comparison calculation with values for a slope angle and height of said concrete leveler portion detected by said laser light receiver and slope angle detector and which uses the results of said comparison calculation as the basis for moving said adjustment mechanism whereby said laser light receiver is maintained at a constant height.

3. The concrete leveling apparatus of claim 1, wherein said concrete leveling apparatus is provided with traveling beam legs vertical to a lower portion of both ends of said traveling beam, and said rails being supported by said traveling beam so as to be freely shiftable with respect to said traveling beam when said traveling beam is in a first position, said concrete leveling apparatus further comprising rail legs provided at forward and rearward end portions of said rails, and rails sending means for shifting said rails with respect to said traveling beam, said traveling beam legs and rail legs being formed so as to be freely extendable and contractible such that, when said rail legs are extended into contact with the ground, said traveling beam is adapted for movement along said rails and such that, when said legs of said traveling beam are extended into contact with the ground, said traveling beam is in the first position wherein the rails are freely shiftable with respect to said traveling beam by said sending means.

4. The concrete leveling apparatus of claim 1, wherein said concrete leveler portion has a vibrator plate and means for vibrating said plate.

5. The concrete leveling apparatus of claim 1, further comprising a compactor plate having flexibility in an up and down direction and supported by said vibrator plate such that said vibrator plate is forward of said compactor plate with respect to the direction of travel of said traveling unit.

6. The concrete leveling apparatus of claim 5, further comprising a screw which is of an auger design and which rotates along an axes extending transverse to the direction of travel of said traveling unit, and said screw being supported by said traveling unit in a position forward of said vibrator plate with respect to the direction of travel of said traveling unit.

7. The concrete leveling apparatus of claim 6, wherein said screw includes a main screw section having an exterior concrete contacting edge and an auxiliary screw section having an exterior concrete contacting edge, and the exterior concrete contacting edge of said auxiliary screw being positioned further from an underlying plane than the concrete contacting edge of said main screw section, and said auxiliary screw section extending outwardly off an end of said main screw section.

* * * * *